United States Patent [19]

Hooper et al.

[11] 3,993,014

[45] Nov. 23, 1976

[54] ARTICULATED PUSH TUG-BARGE THRUST TRANSMITTAL MEANS

[75] Inventors: Ralph W. Hooper, Newtown Square, Pa.; Douglas A. MacLeod, Wenonah, N.J.; Clarence Murray, Media, Pa.

[73] Assignee: Interstate Oil Transport Company, Philadelphia, Pa.

[22] Filed: Aug. 7, 1975

[21] Appl. No.: 602,557

[52] U.S. Cl. ..... 114/235 R

[51] Int. Cl.[2] ..... B63B 21/56

[58] Field of Search ..... 114/235 R, 235 A, 77 R, 114/77 A

[56] References Cited

UNITED STATES PATENTS

| | | | |
|---|---|---|---|
| 1,520,144 | 12/1924 | Sansom | 114/235 R |
| 2,684,653 | 7/1954 | Dyer | 114/235 A |
| 3,446,173 | 5/1969 | Ohcho et al. | 114/235 R |
| 3,735,722 | 5/1973 | Hooper et al. | 114/235 R |
| 3,910,219 | 10/1975 | Ono et al. | 114/235 R |

*Primary Examiner*—Trygve M. Blix
*Assistant Examiner*—Stuart M. Goldstein
*Attorney, Agent, or Firm*—Miller & Prestia

[57] ABSTRACT

Thrust transmittal means for push tug and barge comprises, on the tug, a forwardly projecting member with a hemispheric convex frontal surface and, on the barge, a concave hemispheric thrust receiving surface. Preferably, several (or at least two) such receiving members are mounted at vertically spaced points on the rear of the barge. An articulated joint (to permit relative pitching of tug and barge) is thus provided with no coupling device other than the normal chains, cables or lines, suspended in tension between the tug and barge to prevent separation thereof. Preferably, such chains, cables or lines include a hook and eye link with a releasable retainer to facilitate unhooking of same, even under emergency conditions. At the rear of the barge, a deep notch with sidewalls is provided to receive the bow of the tug with fenders between these sidewalls and the adjacent tug sides to prevent relative roll between tug and barge.

5 Claims, 4 Drawing Figures

ARTICULATED PUSH TUG-BARGE THRUST TRANSMITTAL MEANS

This invention pertains to a push tug-barge thrust transmittal means and more particularly to a simplified articulated thrust transmittal means which permits moving tow in moderately high seas. Still more particularly, this invention relates to such a thrust transmittal means which does not include a mechanical coupling, and which therefore facilitates expedient disengagement of tug and barge, when necessary.

Push tug-barge combinations are generally unable to tolerate high seas. To rectify this problem, various means have been proposed, some of which permit some relative movement between tug and barge. A type of such thrust transmittal means is generally referred to as articulated couplings. Such couplings are seen, for example, in U.S. Pat. Nos. 1,550,354-Foulkes; 2,715,380-Archer; 3,035,536-Archer; 3,109,406-Stockdale; 3,461,829-Mosvold; 3,568,621-Kawasaki; 3,645,225-Lunde; 3,802,375-Janssen; 3,804,052-Lucht; 3,830,136-Janssen; 3,605,675-Clemence, Jr., 3,756,183-Clemence, Jr.; and 3,735,722-Hooper; the last three being of common assignment herewith.

All of the designs heretofore known have however included certain inherent shortcomings. Among those designs shown in the above cited prior art patents, several include mechanical coupling retainer means as part of the thrust transmittal system, such that the thrust transmitting members include securing means to prevent coupling disengagement. Such means interfere with the rapid disengagement of the tug and barge, should such disengagement become necessary under emergency conditions. Perhaps for this reason, the Coast Guard has indicated that a tug-barge combination with such coupling means must be considered an integrated unit, with attendant inspection, certification and crew requirements beyond that necessary for tug and barge ordinarily.

In addition, at least one thrust transmitting means has been proposed, which appears to permit articulation but which actually does not. Upon close inspection of U.S. Pat. No. 2,684,653-Dyer, it is noted that flat abutting surfaces 38, 39 are provided with an elongated thrust member extending into an elongated receptacle (see particularly FIG. 2 of that patent) which prevents such articulation as may be necessary to permit the engaged tug and barge to remain in engagement in heavy seas.

Further, a commercially operating push tug-barge arrangement is known in which thrust transmittal is accomplished through members projecting forwardly from the tug and rearwardly from the barge, the mating ends of the projecting members including a cylindric convex surface member at the end of the rearwardly projecting barge piece and a cylindric concave surface at the forward end of the bow piece. This arrangement permits articulation between barge and tug in a vertical plane about the point of engagement of the thrust transmitting device. A notch with rearwardly extending sidewalls on the barge and fenders between the tug and barge prevent relative roll in this system.

Having in mind all of these problems, it is the general object of the present invention to provide a push tug-barge thrust transmittal means which facilitates both engagement and disengagement of tug and barge, which is relatively simple, though effective, and which permits some interchangeable use of tug and barge with other barges and tugs not including the thrust transmittal means of this invention.

A further object of this invention is to provide an articulated thrust transmittal means for a push tug and barge which permits the tug and barge to remain in engagement in relatively high seas but which also permits rapid disengagement under emergency conditions.

A more specific object of this invention is to provide such a thrust transmittal means which may be adapted to permit engagement of tug and barge at different relative drafts of tug and barge and in which the fixed lateral positioning of tug and barge is assured.

These objects, and others which will be apparent in the course of the subsequent description, are met, briefly, by a push tug and barge thrust transmittal means comprising a cylindrical member projecting forwardly from the bow of the tug, that member including a convex hemispheric frontal surface at its forward end, and a thrust receiving surface or member at the stern of the barge on the center line thereof, the receiving member having a concave surface adapted to receive the convex frontal surface of the bow member. Preferably, the convex and concave surfaces are hemispheric, so that the mating surfaces are self-centering. These concave-convex mating surfaces of the thrust transmittal means of this invention permit relative pitching, or articulation, between a tug and barge. This permits tug and barge to remain in engagement despite relatively high seas. The mating surfaces may be lubricated to reduce frictional restraint of this motion. The degree to which such lubrication may be required is not known. However, in the only full scale embodiment of this invention built to date, lubrication grooves are provided running longitudinally on the push member extending from the tug, the longitudinal groove terminating at the center point of the convex hemispheric pushing surface. Further, an automatic lubrication system is provided, with its single outlet at that central point, communicating with a passageway within the projecting member and a lubricant source with means for pressurizing same to drive lubricant to the central point of the front of the pushing member and then into the lubricant grooves. This lubrication system can be used to lubricate the mating push surfaces even while the tug and barge are in engagement.

A deep notch with extended sidewalls at the rear of the barge is provided to receive the bow of the tug. Fenders or bumpers between these sidewalls and the sides of the tug limit relative rolling motion between tug and barge and assure correct lateral positioning of tug and barge. Since these contacting fenders or bumpers experience some relative vertical motion of tug and barge during relative pitching of tug and barge, the frictional restraint on this movement may be reduced by lubricating these surfaces or by providing rollers or other similar mechanical means on either the tug or barge to mate with the otherwise standard adjacent fenders. To provide greater contact area, the barge notch sidewalls may be provided with bulwarks, above the deck level of the barge, and deep keels, by plating extending upwardly and downwardly from along the notch sidewalls.

The cylindrical projecting member in the bow of the tug may also be retractable, by any conventional retraction means, into the bow of the tug in order to facilitate the use of the tug for pushing barges not fitted with the receiving means of the present invention.

In any event, upon pushing engagement of the thrust transmittal means of this invention and the tug and barge including such thrust transmittal means, separate means may be provided to restrain by conventional means, such as cables, chains or hawsers suspended in tension between the tug and barge, the tug and barge from separating from one another. The primary thrust transmittal means described above, together with these restraining means are all horizontally disposed from one another so that when tug and barge are in engagement all of their connections lie in a common horizontal line, which serves as a hinge line similar to the hinge concept of earlier articulated push tug-barge couplings, such as those shown in the previous patents of the assignee of this invention, referred to above. In accordance with present practice, the hawsers, chains or cables holding tug and barge together may be quickly released in order to facilitate rapid disengagement of tug and barge under emergency conditions. Preferably, such chains are hooked to posts provided on the stern of the barge on either side of the thrust transmittal means and coplanar therewith. On the tug, the chains are hooked to releasable links which permit the tensioned chains to be quickly removed from their hook points on the tug. This is particularly important to facilitate separation under emergency conditions. The preferred means comprises a hook with a releasable retainer holding the hook in engagement with the chain. When separation is desired, the retainer is removed from the hook and the hook pivots away from its engaged position and the chain is released.

Finally, in order to accommodate the thrust transmittal means of the present invention to the differing relative drafts of the tug and barge depending upon the load of each, a plurality (at least two) thrust receiving members and chain posts may be provided on the rear of the barge, these members of course being vertically spaced from one another to receive the bow projecting member from the tug at a convenient vertical position, depending on the drafts of tug and barge at the particular time of engagement.

This invention may be better understood by reference to the following detailed description of the preferred embodiment thereof, taken in conjunction with the sub-joined claims and the drawings, in which:

Figure 1:
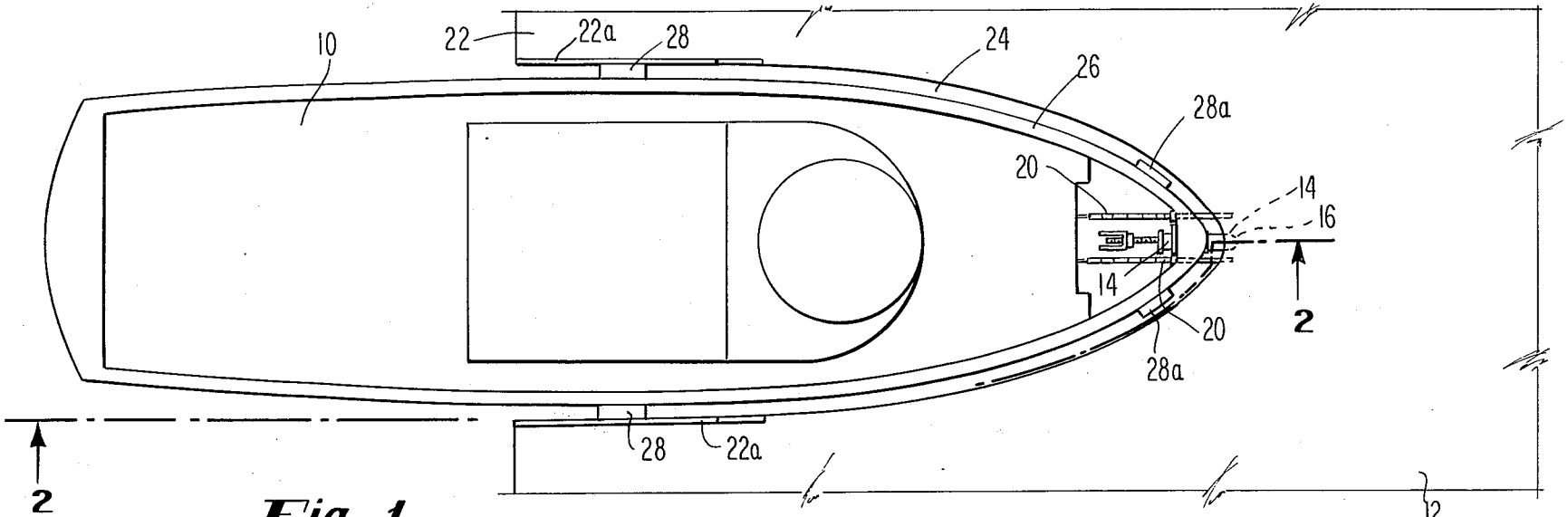
FIG. 1 is a plan view of a push tug and barge, incorporating the thrust transmittal means of the present invention, showing the tug and barge in their engaged positions.

Referring more specifically to FIG. 1, there is seen push tug 10 and barge 12. Mounted on the tug 10 is a thrust transmitting cylindrical forwardly projecting beam member 14 with a hemispherically convex frontal surface 16. Frontal surface 16 is received in centrally mounted thrust transmittal receiving member 18 on the stern of barge 12. Chain means 20 are provided to prevent separation of tug 10 from barge 12 while they are in their engaged positions. Barge 12, at its rear, includes a deep notch 24 for receiving the bow 26 of the tug 10; sidewalls are extended upward with bulwarks **22*a* and downward with deep keel-like extenders 22*b*. The bow 26 of tug 10 with fenders 28 fits in notch 24, with fenders 28 preventing actual contact of tug 10 and barge 12. Bulwarks 22*a* and extenders 22*b* provide greater contact area for fenders 28 and insure contact despite relative pitching of tug and barge. Fenders 28*a*, which do not contact barge 12, are also provided forward on tug 10 for use of tug 10** in combination with other tug barges.

Figure 2:
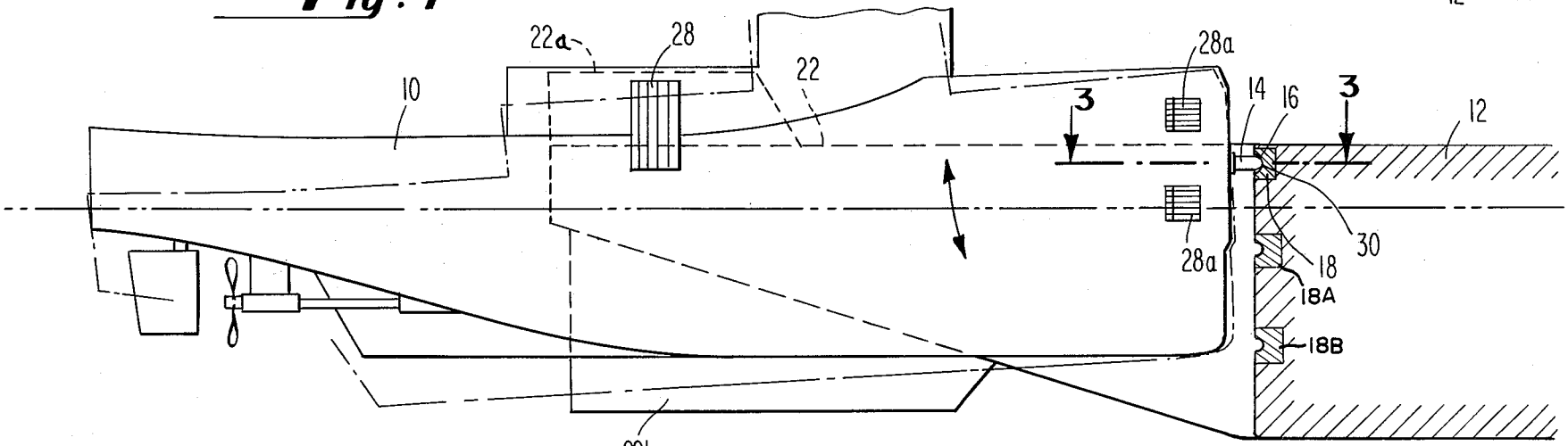
FIG. 2 is a schematic sectional elevation view of the engaged tug and barge shown in FIG. 1.
Figure 3:
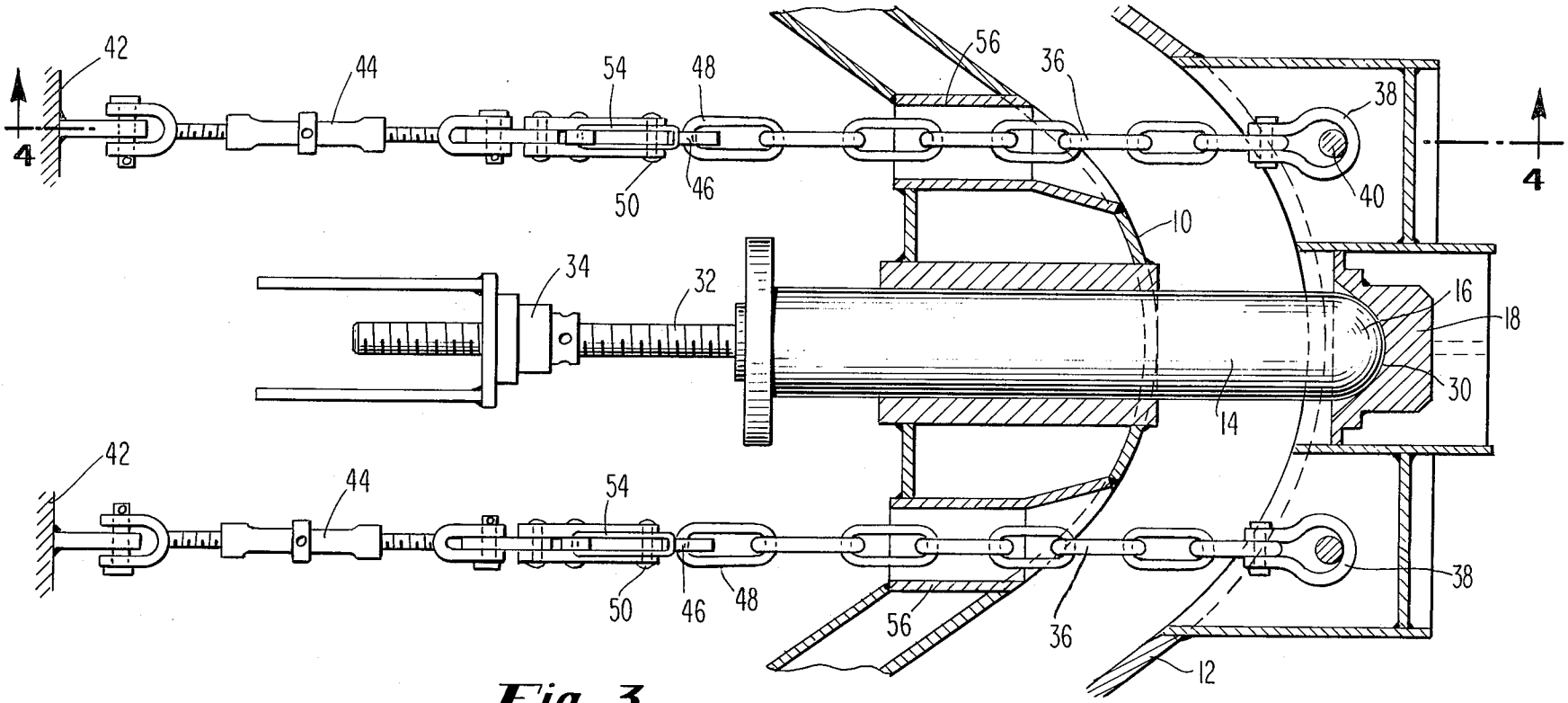
FIG. 3 is a sectional plan view of the thrust transmittal means of the present invention.

As better seen in FIG. 2, beam member 14 with hemispheric convex frontal surface 16 is received in thrust receiving member 18 in a hemispheric concave surface 30 to facilitate articulation therebetween, particularly in a vertical plane, as seen by the phantom position lines of barge 10 shown in FIG. 2. In the enlarged sectional view of the thrust transmittal means of this invention used in tug 10 and barge 12, taken in the plane 3—3 of FIG. 2, and which is shown in FIG. 3, forwardly projecting beam 14 is seen at its rear end to include a threaded member 32 in internally threaded retainer 34. In this preferred form of the present invention, beam 14 may be retracted by threaded member 32 in retainer 34 in order to permit the use of tug 10 as a push tug with other non-mating barges.

Hemispherically concave surface 30 is flared outwardly toward the rear of barge 12 to facilitate proper receiving and positioning of beam member 14 in receiving member 18. It will be noted that the receiving members for the thrust transmittal means of this invention on barge 12 do not project rearwardly therefrom. Barge 12 is therefore adapted to be used with other non-mating tugs. For accommodating different relative drafts of tug and barge, additional thrust receiving members 18A and 18B are disposed at vertically spaced positions from member 18.

Figure 4:
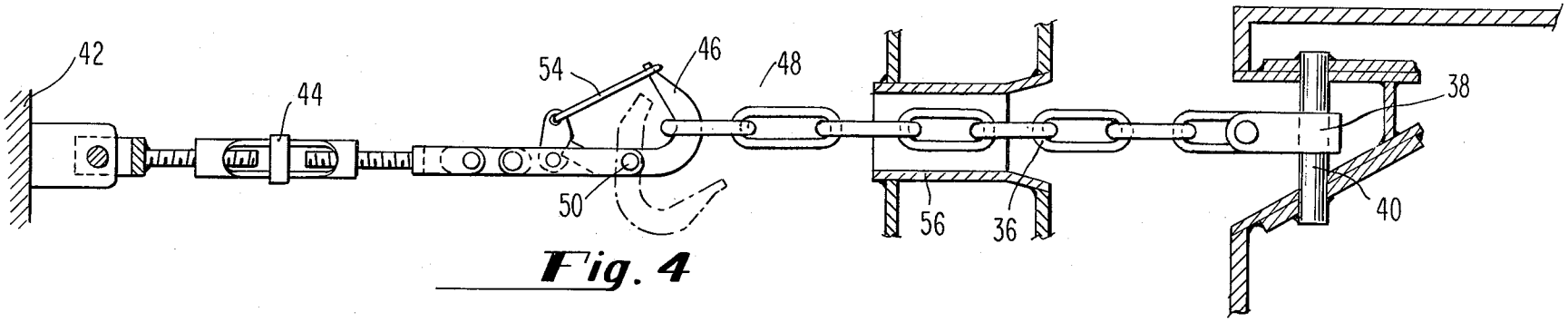
FIG. 4 is a sectional view, in the plane 4—4 of FIG. 3 of the chain releasing means shown in the assembly of FIG. 3.

Referring again to FIG. 3, and to the sectional view of the chain locking means of FIG. 4, it should be noted that while the thrust transmittal means of the present invention permits ready positioning and engagement with no locking or coupling mechanism, means are generally provided to prevent separation of tug and barge. Preferably, such means include tensioned hawsers, chains or cables, such as chains 36 with shackles 38 engaging posts 40, provided for that purpose on the stern of barge 12. Chains 36 are pivotally connected to a fastening member 42 on tug 10, with a length adjustment means, such as turnbuckles 44. Further, chains 36 are preferably associated with a quick disconnect means, such as hook 46. Hook 46 is pivoted at pivot connection 50 and the configuration of hook 46 is such that with chains 36 in tension, hooks 46 tend to slide out of and become disengaged from chains 36. To prevent any such accidental disengagement, a releasable retainer 54 is provided. Retainer 54 is simply pulled upwardly (as seen in FIG. 4) to release chains 36 and permit separation of tug and barge. Chains 36 slide forward in sleeves 56 and out of tug and the untensioned chains 36 are then left to hang free on posts 40.

While other quick disconnect means may be used for the tensioned chains preventing separation of tug and barge, such connecting and disconnecting means for chains are similar to those used conventionally. Accordingly, it will be apparent that the thrust transmittal means of the present invention not only provides a simple articulated engagement between tug and barge, but it does so in a manner requiring no lock up or coupling in the thrust transmittal means other than chains, cables or hawsers.

The present invention has been demonstrated to be both effective and efficient. As compared to conventional tug-barge systems, hydrodynamic drag is considerably reduced, course stability is improved, and a quick releasable push tug-barge thrust transmittal system, capable of tolerating moderately high seas, is thus obtained. In general, increased speeds are obtainable, and the overall net effect is an improvement in fuel efficiency over conventional tug-barge systems.

While this invention has been described with reference to a specific and preferred embodiment thereof, it should be understood that it is not limited thereto and numerous equivalent variations and modifications may be made by those skilled in the art without departing from the true spirit and scope thereof. For example, the convex mating surface may be disposed on a member associated with the barge, rather than the push tug as illustrated herein, with a mating concave pushing surface associated with the tug. In this case, a retractable beam may be associated with the barge rather than the tug and the thrust transmittal member of the tug may comprise a bow mounted, non-projecting member with a concave pushing surface.

A further feature of the embodiment of this invention described and illustrated above is a yoke and pin means located at the rear of push member 14. With member 14 in its forward or pushing position, the yoke and pin means is secured to a hull member so that the full thrust force is not exerted through the threads of threaded member 32 but rather through the yoke and pin means.

Still another extention of this invention involves modification of the front of the barge of this invention to provide a bow with an extended push member, similar to that shown in the tug herein, to permit mating of several such barges and therefore to permit multiple barge pushing. All such modifications and variations are intended to be covered by the appended claims.

We claim as our invention:

1. Push tug and barge with thrust transmittal means comprising:

a. cylindrical member projecting forwardly from the bow of the tug, said cylindrical member including at its forward end a convex hemispheric frontal surface;

b. a thrust receiving member mounted centrally on the stern of said barge, said receiving member including a hemispheric concave surface adapted to receive and mate with said convex frontal surface of said cylindrical member;

c. the mating surfaces formed between the cylindrical and receiving members providing the sole means of transmitting pushing thrust to said barge from said tug while permitting relative pitching therebetween;

d. a notch at the stern of said barge with sidewalls on the two sides thereof, said barge stern and sidewalls and the bow of said tug being adapted so that said bow fits between said sidewalls upon engagement of said tug and barge, including fenders, rollers or other means through which contact is made between said sidewalls and the sides of said tug to limit relative motion therebetween; and e. quickly releasable means independent of said cylindric and thrust receiving members, to restrain said tug and barge from separating from one another.

2. Push tug and barge, as recited in claim 1, wherein said convex surface is defined by a slightly smaller radius than that of said concave surface.

3. Push tug and barge, as recited in claim 1, wherein said cylindrical member is retractable into the bow of said tug.

4. Push tug and barge, as recited in claim 1, wherein said barge includes a plurality of said receiving members vertically spaced from one another.

5. Push tug vessel and barge vessel with thrust transmittal means therebetween comprising:

a. member projecting from one of said vessels to the other of said vessels;

b. thrust receiving member mounted on the other of said vessels;

c. thrust transmittal surfaces at the interface of said projecting member and said thrust receiving member, said interface surfaces comprising respectively hemispheric convex and concave surfaces adapted to mate with one another and said surfaces providing the sole means of transmitting pushing thrust from said barge to said tug while permitting relative pitching therebetween;

d. a notch at the stern of said barge with sidewalls on the two sides thereof, said barge stern and said sidewalls and the bow of said tug being adapted so that said bow fits between said sidewalls upon engagement of said tug and barge, including fenders, rollers, or other means through which contact is made between said sidewalls and the sides of said tug to limit relative motion therebetween; and e. quickly releasable means independent of said cylindric and thrust receiving members, to restrain said tug and said barge from separating from one another.

* * * * *